US007297101B2

(12) United States Patent
Neisz et al.

(10) Patent No.: US 7,297,101 B2
(45) Date of Patent: Nov. 20, 2007

(54) METHOD AND APPARATUS FOR MINIMALLY INVASIVE PLACEMENT OF SENSING AND DRIVER ASSEMBLIES TO IMPROVE HEARING LOSS

(75) Inventors: Johann J. Neisz, Coon Rapids, MN (US); Eric Kraus, Greensboro, NC (US); Michael Glasscock, Austin, TX (US); Aaron Thornton, West Des Moines, IA (US); John F. Kveton, Branford, CT (US)

(73) Assignee: Envoy Medical Corporation, Minneapolis, MN (US)

( * ) Notice: Subject to any disclaimer, the term of this patent is extended or adjusted under 35 U.S.C. 154(b) by 0 days.

(21) Appl. No.: 11/332,981

(22) Filed: Jan. 17, 2006

(65) Prior Publication Data

US 2006/0178553 A1 Aug. 10, 2006

Related U.S. Application Data

(60) Provisional application No. 60/644,204, filed on Jan. 14, 2005.

(51) Int. Cl.
*H04R 25/00* (2006.01)

(52) U.S. Cl. ..... 600/25

(58) Field of Classification Search ..... 600/25; 607/55–57; 181/129–137; 381/312–324
See application file for complete search history.

(56) References Cited

U.S. PATENT DOCUMENTS

| | | | |
|---|---|---|---|
| 4,729,366 | A | 3/1988 | Schaefer |
| 6,267,731 | B1 | 7/2001 | Kroll et al. |
| 6,540,662 | B2 | 4/2003 | Kroll et al. |
| 6,730,015 | B2 * | 5/2004 | Schugt et al. ..... 600/25 |
| 6,755,778 | B2 | 6/2004 | Kroll et al. |
| 2003/0032856 | A1 | 2/2003 | Kroll et al. |
| 2004/0264725 | A1 | 12/2004 | Madsen et al. |

* cited by examiner

*Primary Examiner*—John P. Lacyk
(74) *Attorney, Agent, or Firm*—Fredrikson & Byron, P.A.

(57) ABSTRACT

Methods and structures for placing sensing and driver assemblies in a middle ear of a patient are disclosed. Methods and structures according to various embodiments of the invention provide minimally invasive techniques and devices that facilitate placement of sensing/driver assemblies in a middle ear using a trans-canal implantation technique. Certain embodiments include placement of a longitudinal body through the ear canal for mounting in the middle ear, and for supporting a sensing/driving assembly subsequently coupled thereto.

8 Claims, 8 Drawing Sheets

METHOD AND APPARATUS FOR MINIMALLY INVASIVE PLACEMENT OF SENSING AND DRIVER ASSEMBLIES TO IMPROVE HEARING LOSS

RELATED APPLICATIONS

This application claims priority from provisional application Ser. No. 60/644,204, filed Jan. 14, 2005, the entire disclosure of which is hereby incorporated by reference.

FIELD

The disclosure relates generally to implantable hearing aid systems, and more particularly to methods and structures for placing sensing and driving components in hearing impaired persons.

BACKGROUND

In some types of partial middle ear implantable (P-MEI) or total middle ear implantable (T-MEI) hearing aid systems, sounds produce mechanical vibrations within the ear which are converted by an electromechanical input transducer into electrical signals. These electrical signals are in turn amplified and applied to an electromechanical output transducer. The electromechanical output transducer causes an ossicular bone to vibrate in response to the applied amplified electrical signals, thereby improving hearing.

An electromechanical transducer used for the purpose of vibrating or sensing from any or all elements of the ossicular chain may be mounted in or near the middle ear. The transducer is generally contained in a housing or enclosure, forming a driver or sensing assembly that facilitates the placement of the transducer within the middle ear.

Installation of sensing/driver assemblies frequently involves mastoid surgery (e.g., at least a partial mastoidectomy) to place the sensing/driver assemblies in the middle ear of a patient. This is a relatively invasive procedure, and may extend the length of time required both for the installation of a an implantable hearing aid system, as well as for recovery of a patient.

It is therefore desirable to provide methods and structures for mounting sensing/driver assemblies of middle ear implantable hearing aid systems that does not require mastoid surgery.

SUMMARY OF THE INVENTION

In certain embodiments of the invention, a mounting assembly for mounting sensing/driver assemblies in a middle ear space is disclosed which includes a longitudinal body portion that may conform substantially to the inner surface of the tympanic cavity. The longitudinal body portion may allow for a sensing/driver assembly to be mounted thereto. Certain embodiments of the invention provide a longitudinal body portion that may be placed into the tympanic cavity via a trans-canal implantation approach. Further embodiments may optionally include an anchor portion coupled to the longitudinal body portion to thereby facilitate securing the mounting assembly to a bone structure within the tympanic cavity of a patient.

In certain embodiments of the invention, a mounting assembly for mounting sensing/driver assemblies in a middle ear space is disclosed which includes a longitudinal body portion adapted to substantially span a chord of a tympanic cavity. The longitudinal body portion may have first and second ends, either or both of which may include fixation means for securing an end of the longitudinal body portion to a bone structure within the tympanic cavity. In certain embodiments, the longitudinal body portion may be placed into the tympanic cavity via a trans-canal approach. Further embodiments may include a longitudinal body portion adapted for placement in the tympanic cavity in a substantially horizontal configuration to facilitate placement and support of a sensing/driving assembly thereon.

In certain embodiments of the invention, an implantable hearing aid system is disclosed which includes a mounting assembly adapted for installation using a trans-canal implantation technique. A hearing aid system in accordance with various embodiments of the invention may include a driver assembly, a sensing assembly, a mounting assembly to support at least one of the sensing/driver assemblies, an electronics unit, and leads coupling the sensing/driver assemblies to the electronics unit, wherein the mounting assembly and the at least one sensing/driver assembly are formed to allow passage through a tympanic membrane to facilitate a trans-canal implantation.

In certain embodiments of the invention, a method of placing sensing/driver assemblies in a middle ear space of a patient is disclosed which includes cutting at least a portion of a tympanic membrane, placing a mounting assembly through an ear canal and affixing it to a bony structure of the middle ear space, placing a sensing/driver assembly through the ear canal and coupling it to the mounting assembly.

DETAILED DESCRIPTION

Figure 1:
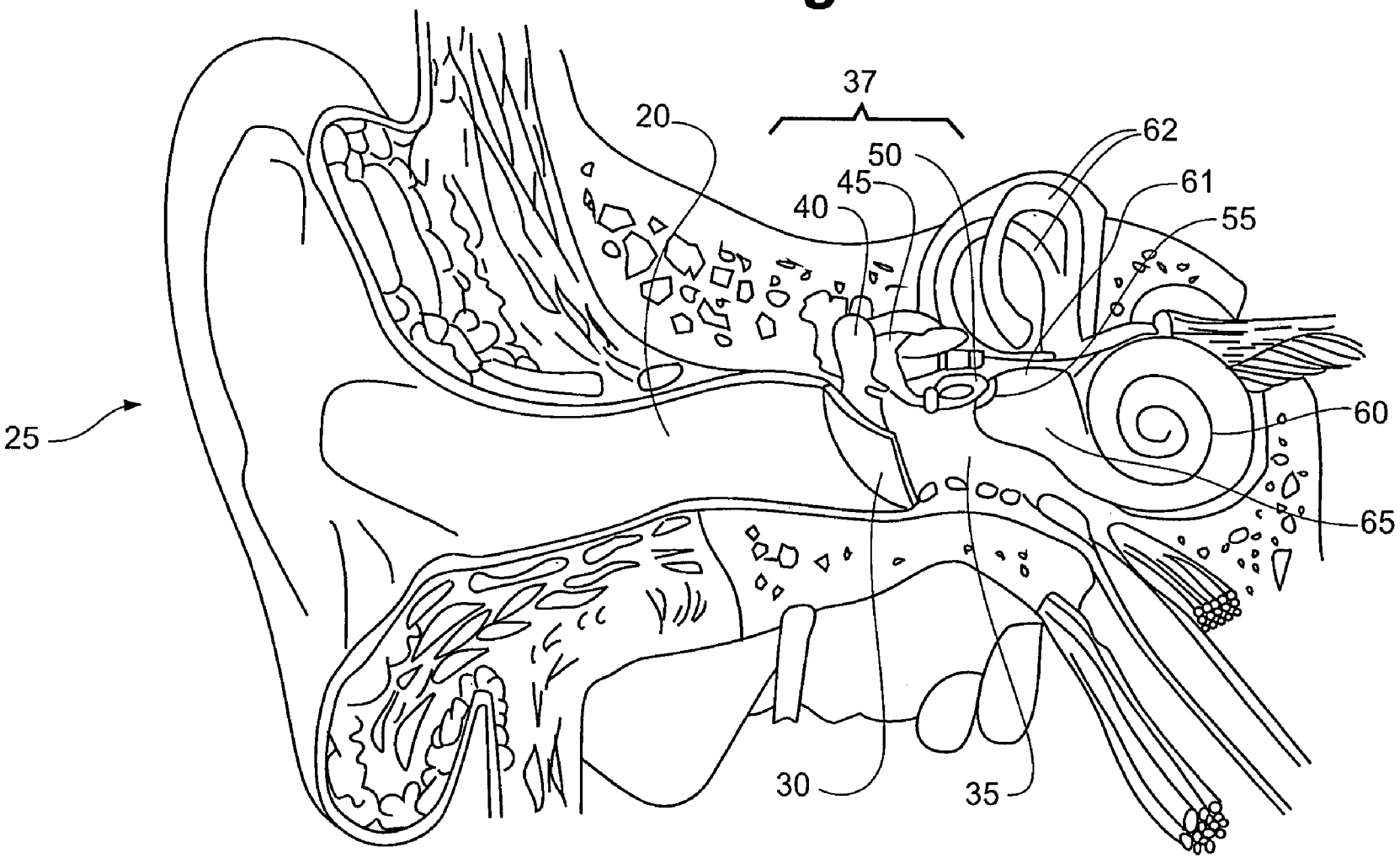
FIG. 1 illustrates a frontal section of an anatomically normal human right ear.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

Embodiments of the invention provide a method and apparatus for placing sensing/driver assemblies (such as those used in partial middle ear implantable (P-MEI), total middle ear implantable (T-MEI), or other hearing aid systems) into a middle ear space using a minimally invasive procedure and/or a novel mounting structure. A P-MEI or T-MEI hearing aid system may be installed to assist the human auditory system in converting acoustic energy contained within sound waves into electrochemical signals delivered to the brain and interpreted as sound.

The sensing/driver assemblies and/or mounting means of various embodiments of the invention facilitate a trans-canal implant procedure by which portions of the hearing aid system are implanted, in certain embodiments, through the auditory canal and the tympanic membrane into the middle ear without the need for mastoid surgery.

FIG. 1 illustrates, generally, the human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal, between it and the tympanic cavity (middle ear) 35. Variations in the sound waves produce tympanic vibrations. The mechanical energy of the tympanic vibrations is communicated to the inner ear, including the cochlea 60, vestibule 61, and semicircular canals 62, by a sequence of articulating bones located in the middle ear 35. This sequence of articulating bones is referred to generally as the ossicular chain 37. Thus, the ossicular chain transforms acoustic energy at the eardrum 30 to mechanical energy at the cochlea 60.

The ossicular chain 37 includes three primary components: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of a hearing aid system, tympanic vibrations are mechanically conducted through the malleus 40, incus 45, and stapes 50, to the oval window 55. Vibrations at the oval window 55 are conducted into the fluid filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain 37, and/or cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain 37 lacking sufficient resiliency to transmit mechanical vibrations between the tympanic membrane 30 and the oval window 55. As a result, fluidic motion in the cochlea 60 is attenuated. Thus, receptor cells in the cochlea 60 do not receive adequate mechanical stimulation. Damaged elements of ossicular chain 37 may also interrupt transmission of mechanical vibrations between the tympanic membrane 30 and the oval window 55.

Implantable hearing aid systems have been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe.

A particularly interesting class of hearing aid systems includes those which are configured for disposition principally within the middle ear 35 space. In middle ear implantable (MEI) hearing aids, an electrical-to-mechanical output transducer couples mechanical vibrations to the ossicular chain 37, which is optionally interrupted to allow coupling of the mechanical vibrations to the ossicular chain 37. Both electromagnetic and piezoelectric output transducers have been used to effect the mechanical vibrations upon the ossicular chain 37.

One example of a partial middle ear implantable (P-MEI) hearing aid system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain 37. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain 37 or to the oval window 55 or round window 65. In the '366 patent, the ossicular chain 37 is interrupted by removal of the incus 45. Removal of the incus 45 prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer may ease implantation into the middle ear 35. The lower power consumption of the piezoelectric output transducer is particularly attractive for T-MEI hearing aid systems, which include a limited longevity implanted battery as a power source.

A piezoelectric output transducer is typically implemented as a ceramic piezoelectric bi-element transducer, which is a cantilevered double plate ceramic element in which two opposing plates are bonded together such that they amplify a piezo electric action in a direction normal to the bonding plane. Such a bi-element transducer vibrates according to a potential difference applied between the two bonded plates. A proximal end of such a bi-element transducer is typically cantilevered from a transducer mount which is secured to a temporal bone within the middle ear. A distal end of such a bi-element transducer couples mechanical vibrations to an ossicular element such as stapes 50.

Figure 2:
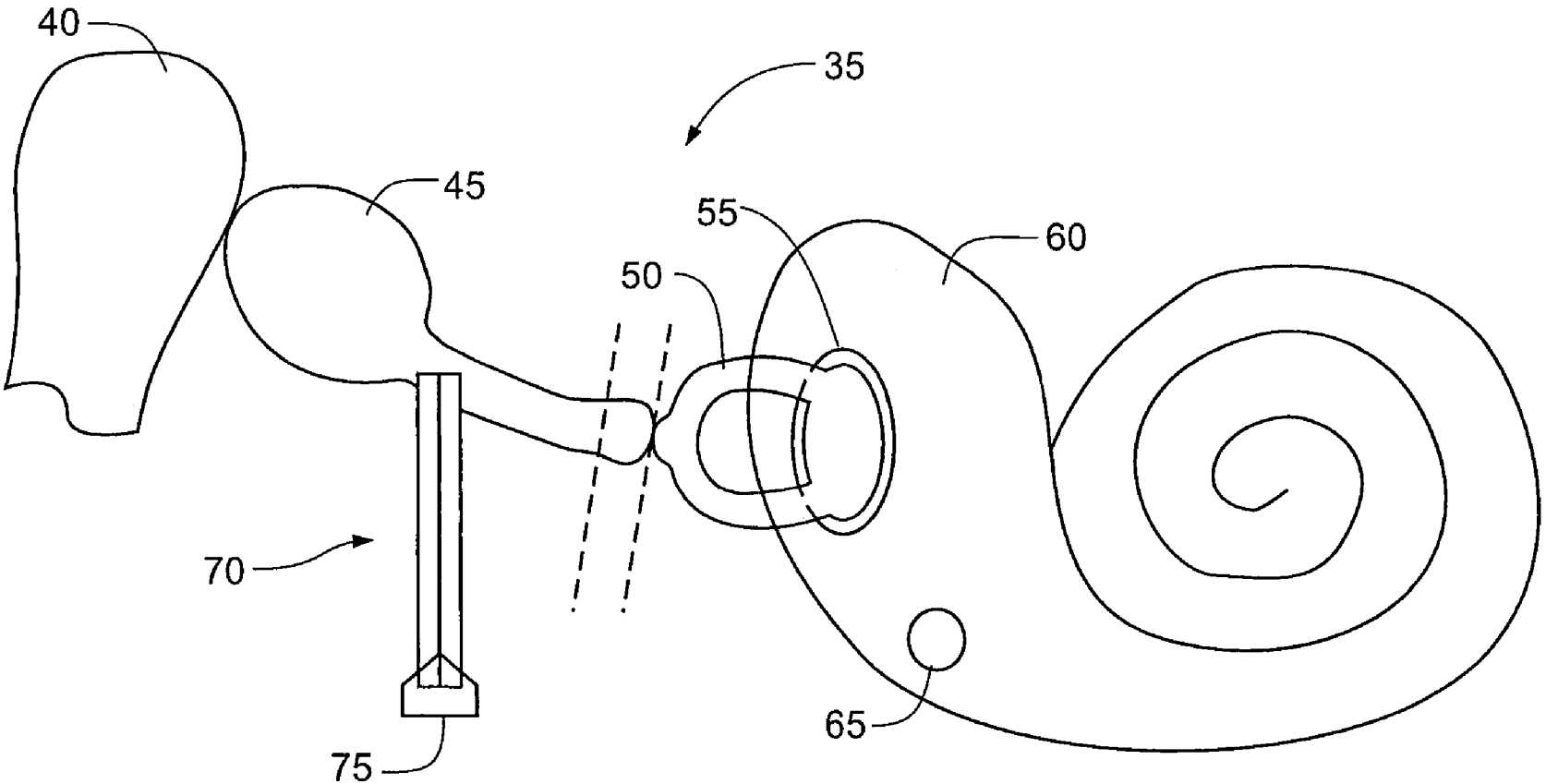
FIG. 2 is a generalized illustration of a transducer and housing mounted within a middle ear.

FIG. 2 is a generalized illustration of a transducer 70 cantilevered at its proximal end from a housing 75 mounted within a middle ear 35. A distal end of the transducer 70 is mechanically coupled to an auditory element to receive or effect mechanical vibrations when operating as an input or output transducer, respectively. For example, to receive mechanical vibrations as an input transducer, transducer 70 may be coupled to an auditory element such as a tympanic membrane 30, malleus 40, or incus 45. In another example, to effect vibrations as an output transducer, transducer 70 may be coupled to an auditory element such as incus 45, stapes 50, oval window 55, round window 65, vestibule 61, or semicircular canal 62. FIG. 2 also shows that incus 45 may be disarticulated from stapes 50 (indicated by dotted lines) in certain configurations.

Figure 3:
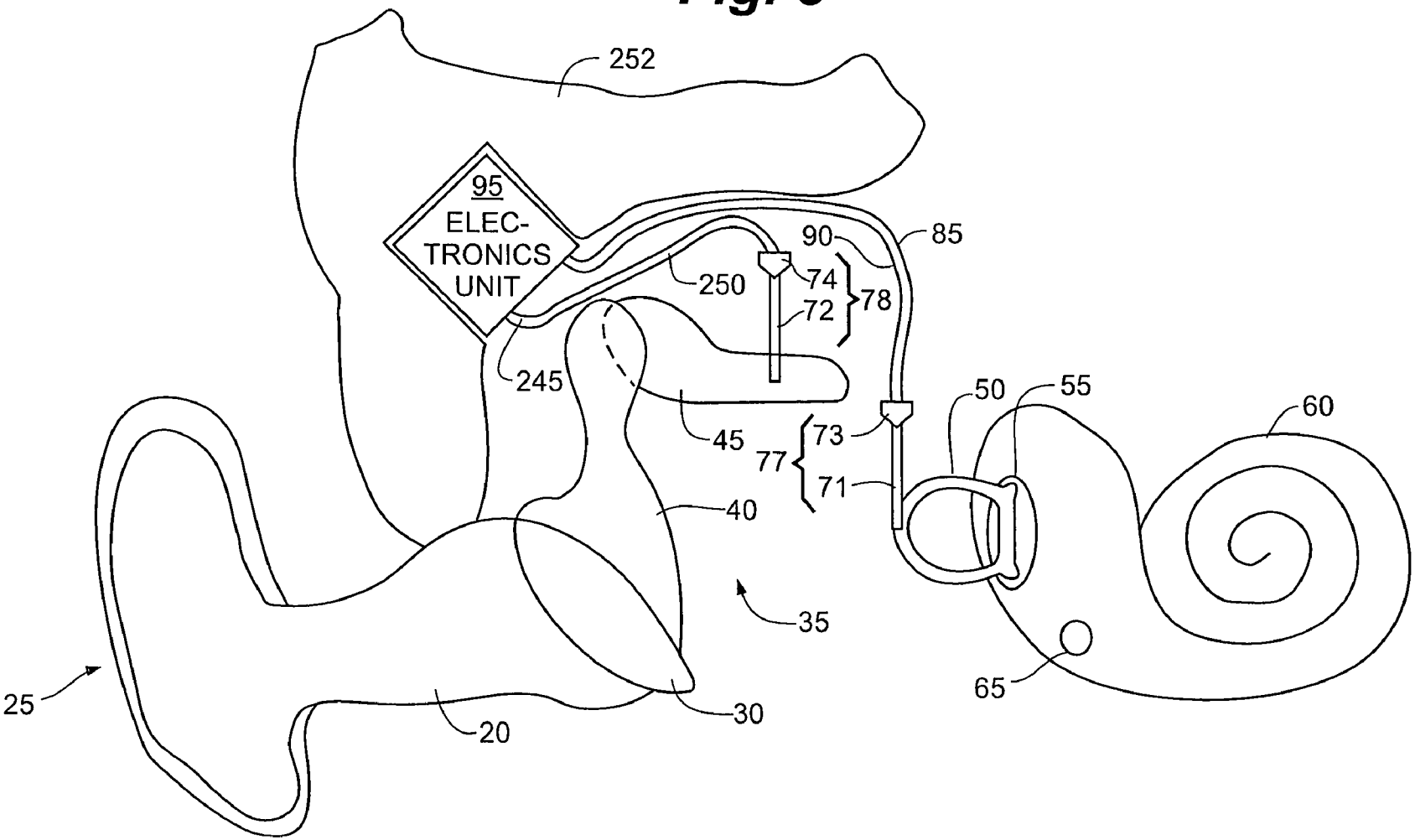
FIG. 3 is a generalized illustration of a typical T-MEI hearing aid system, including both driver and sensor assemblies.

FIG. 3 illustrates generally a cross-sectional view of a T-MEI hearing aid system. Electromechanical input transducer 72 is mounted within middle ear 35 via housing 74, forming the sensing assembly 78 portion of the T-MEI hearing aid system. Electromechanical input transducer 72 is coupled by any known attachment technique at its distal end, such as described above, to an auditory element such as malleus 40. Electromechanical input transducer 72 may also be secured to other auditory elements for receiving mechanical vibrations, such as incus 45 or tympanic membrane 30. As shown, vibrations of incus 45 at the distal end of electromechanical input transducer 72 cause vibratory displacements of the electromechanical input transducer 72. As a result, an electrical signal is generated and transmitted through respective lead wires 245 and 250 to electronics unit 95.

Also illustrated in FIG. 3 is an electromechanical output transducer 71. Electromechanical output transducer 71 is mounted within middle ear 35 via housing 73, forming the driver assembly 77 portion of the T-MEI hearing aid system. Electromechanical output transducer 71 is coupled at its distal end to middle ear 35 only through an auditory element, preferably stapes 50, or alternatively incus 45, oval window 55, round window 65, vestibule 61, or semicircular canals 62. Electromechanical output transducer 71 is secured to stapes 50, for example, by any known attachment technique, including biocompatible adhesives or mechanical fasteners.

Electronics unit 95 couples an electrical signal through lead wires 85 and 90 to any convenient respective connection points on housing 73. In response to electrical signals received from electronics unit 95, the electromechanical output transducer 71 generates and mechanically couples vibrations to stapes 50. The vibrations coupled to stapes 50 are in turn transmitted to cochlea 60 at oval window 55.

Figure 4:
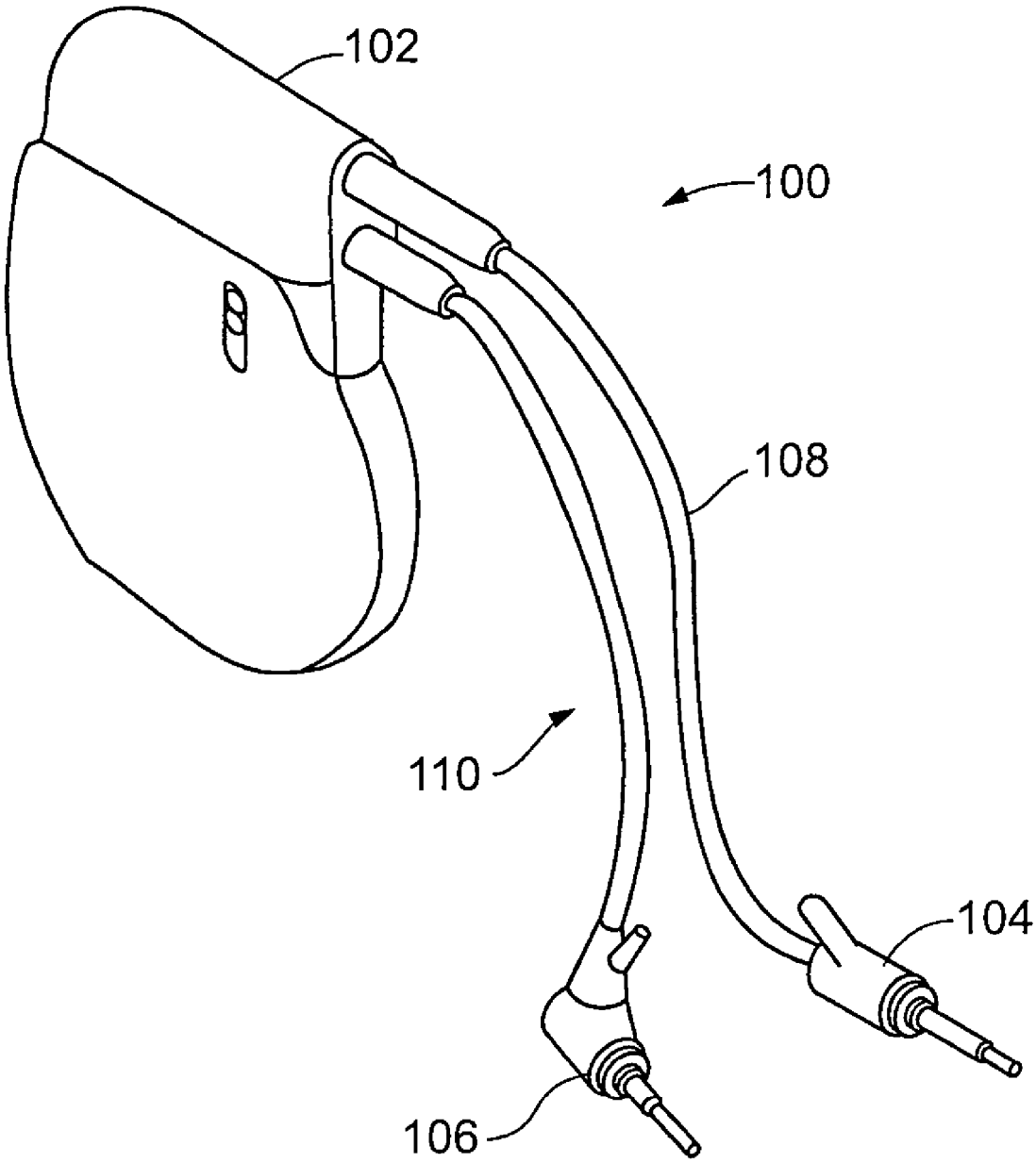
FIG. 4 is a perspective view of a T-MEI hearing aid system.

FIG. 4 is a perspective view of a hearing aid system 100 that may be used in conjunction with certain embodiments of the invention. The hearing aid system 100 includes an electronics unit 102, a driver assembly 104 and a sensing assembly 106, the driver assembly 104 and sensing assembly 106 coupled to the electronics unit 102 via leads 108, 110 respectively. The hearing aid system 100 is intended to be implantable in a human being. In particular, the hearing aid system 100 is intended to help improve the hearing of human beings with mild to severe sensorineural hearing loss. The sensing assembly 106 may be attached to the maileus and/or incus bone and the driver assembly 104 may be attached to the stapes in the middle ear as will be described hereinafter. The electronics unit 102 may be implanted in the skull, preferably behind the ear. The electronics unit 102 includes a sound processor (not shown) and battery (not shown).

The hearing aid system 100 may use the ear drum 30 as a microphone, picking up natural sounds through the ear canal 20. The sensing assembly 106 may be adapted to pick up vibrations from the eardrum 30 and/or the malleus 40 and/or incus 45 and converts the vibrations into electrical signals which are sent to the electronics unit 102 via leads 110. The electronics unit 102 filters and amplifies the electrical signals and sends them to the driver assembly 104 via leads 108. The electronics unit 102 is capable of being programmed to customize it for the particular human being in which the hearing aid system 100 is implanted. The electronics unit 102 also houses a battery (not shown) to power the system.

The driver assembly 104 may be coupled to the stapes 50. It converts electrical signals that it has received from the electronics unit 102 back into mechanical vibrations. The driver assembly 104 transmits these sound vibrations effectively to the stapes 50 and oval window 55.

Figure 5:
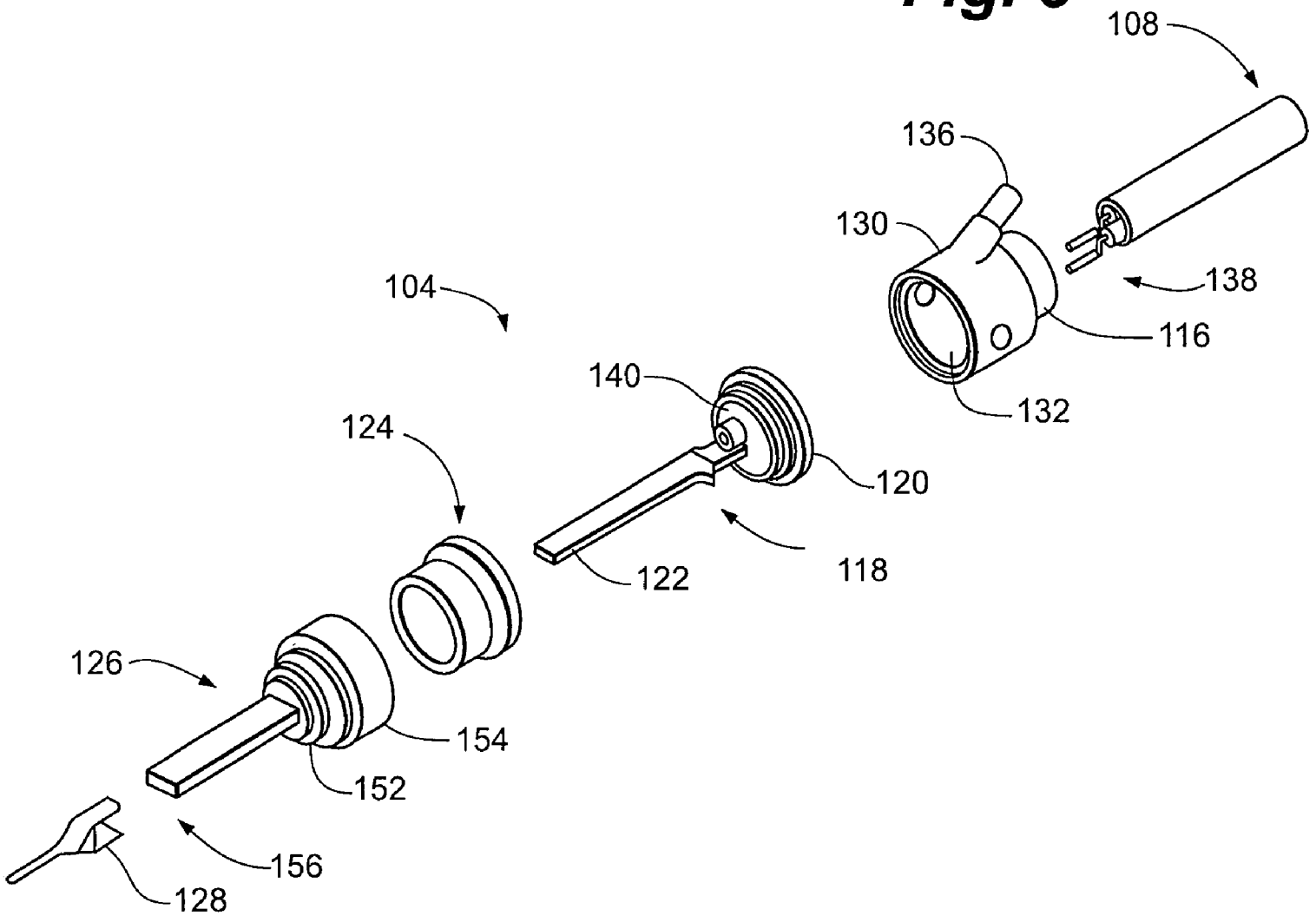
FIG. 5 is a perspective, exploded view of a driver assembly.

An example of a driver assembly is shown in a perspective, exploded view in FIG. 5. The driver assembly 104 includes a housing 116, a transducer assembly 118, a weld ring 124, a sheath 126 and a pin 128. The housing 116 is formed substantially by a cylindrical wall 130 with a lumen 132 extending therethrough. An installation wire socket 136 extends into but not through the cylindrical wall 130 of the housing 116. The transducer assembly 118 includes a feed thru 120 and a transducer 122. The feed thru 120 may be adapted to allow a pair of wires or leads 138 to extend therethrough. On one face of the feed thru 120 are projections 140 through which the leads 138 extend so that they can be electrically coupled to the transducer 122 by brazing, welding, or soldering, for example. The transducer 122 is secured to the feed thru 120 between these projections 140. The transducer 122 is secured to the feed thru 120 by gluing, bonding, soldering, brazing or welding, for example. In an embodiment, the transducer 122 may be a piezoelectric transducer that converts electrical energy to mechanical energy (and vice versa for a sensing assembly, for example), as is known to those of ordinary skill in the art. The feed thru 120 may be composed mainly of two parts, a ceramic disc and a flange encircling the ceramic disc 121.

The sheath 126 has a proximal end 154 and a distal end 156 coupled together by a longitudinal axis. The proximal end 154 is open and the distal end 156 may or may not be open. Extending between the proximal and distal ends 154, 156 is a lumen (not shown) that is dimensioned to house the transducer 122. The sheath has a longitudinal body that generally has a cross-section complementary to the transducer 122. Thus, depending on the shape of the transducer 122, the cross-section of the sheath 126 may be rectangular, square, or circular, for example.

The sensing assembly has a similar construction. For more detail regarding the driver and sensing assemblies, reference is made to U.S. Ser. No. 10/848,785, assigned to present assignee, which is hereby incorporated herein by reference in relevant part.

Certain embodiments of the invention include an alternative and minimally invasive method of placement of hearing system components (e.g., sensing and/or driver assemblies) in a middle ear space. The installation may include a trans-canal access approach for installing a sensing/driver assembly and/or mounting assembly in the middle ear. In certain preferred embodiments, a sensing assembly may be placed between the tympanic membrane and the umbo using a trans-canal placement technique, for example.

The following is a description of a trans-canal approach for accessing the middle ear 35, which may be used for implanting a component of a hearing assistance system (such as a sensing/driving assembly, or a mounting assembly for supporting one or more sensing/driving assemblies, for example) within middle ear space 35 in accordance with certain embodiments of the invention. Further details of this technique are provided in U.S. Pat. No. 6,755,778 to Kroll.

In certain embodiments of the invention, a low profile entry slit or hole is formed in tympanic membrane 30. A mounting assembly in accordance with embodiments of the invention (described below) may then be inserted into and through the slit or hole in tympanic membrane 30. The mounting assembly may then be mounted against a wall of the middle ear space 35, for example. In some embodiments, various portions of a hearing aid system, such as that shown in FIGS. 3 and 4, may be implanted in a middle ear space via tympanic membrane 30, and may thereby avoid the need for performing a mastoidectomy. After insertion and installation of certain hearing aid components through a slit or hole in the tympanic membrane, tympanic membrane 30 will heal appropriately.

Alternately, in certain embodiments of the invention, the tympanic membrane 30 may be "lifted," that is, removed temporarily, to facilitate placement of hearing aid components within a middle ear space. Upon completion of placement and installation, the tympanic membrane may be reattached, for example.

The above methods may permit the insertion of T-MEI or P-MEI components (e.g., mounting assemblies, sensing/driving assemblies, and combinations thereof) into the middle ear without requiring a mastoidectomy. In certain embodiments of the invention, a mounting assembly, for example, may be deployed or reconfigured once positioned in the middle ear space in a different configuration than the configuration used for insertion of the mounting assembly through the tympanic membrane.

In some embodiments, other methods of access may be combined with the above-described trans-canal access approach. For example, an at least partial mastoidectomy may be used to place a driver assembly in a middle ear location suited for stimulating the incus or malleus head, while a trans-canal approach may be used for placement of a sensing assembly in a suitable location, such as in the cavity between the tympanic membrane and the malleus, for example.

Through a trans-canal implantation technique (substantially as described above), a mounting assembly in accordance with certain embodiments of the invention may be installed in the middle ear space allowing for fixation of a sensing/driver assembly thereto. The mounting assembly may be in the form of one or more anchored structures, or in the form of a scaffold structure, placed in the circumferential bony structure behind the tympanic membrane (i.e., the tympanic cavity), as will be described below with reference to FIGS. 6 (*a*) and (*b*). A mounting assembly in accordance with certain embodiments of the invention may also allow for the placement of sensing/driver assemblies using a trans-canal implantation approach, thereby avoiding the need to perform mastoid surgery.

Figure 6A:
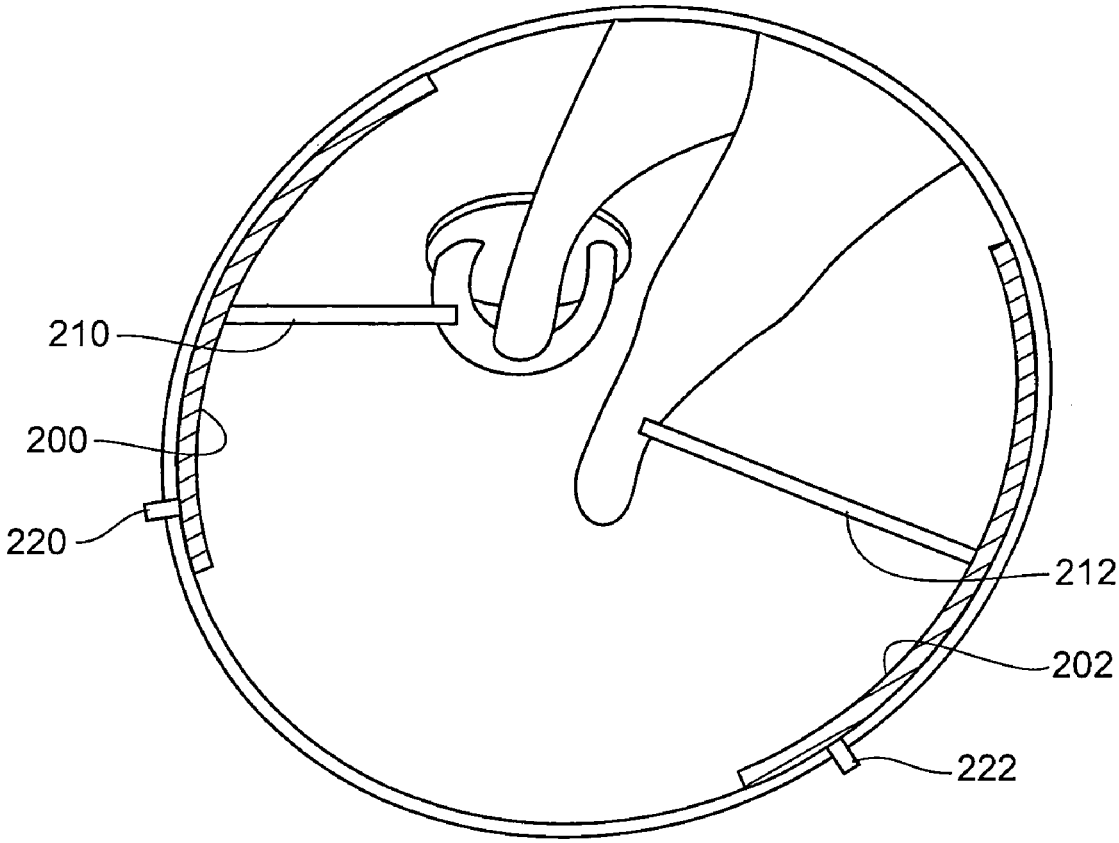
FIGS. 6 (*a*) and (*b*) are schematic views of the tympanic cavity upon removal of the tympanic membrane to illustrate placement of mounting assemblies in accordance with certain embodiments of the invention.
Figure 6B:
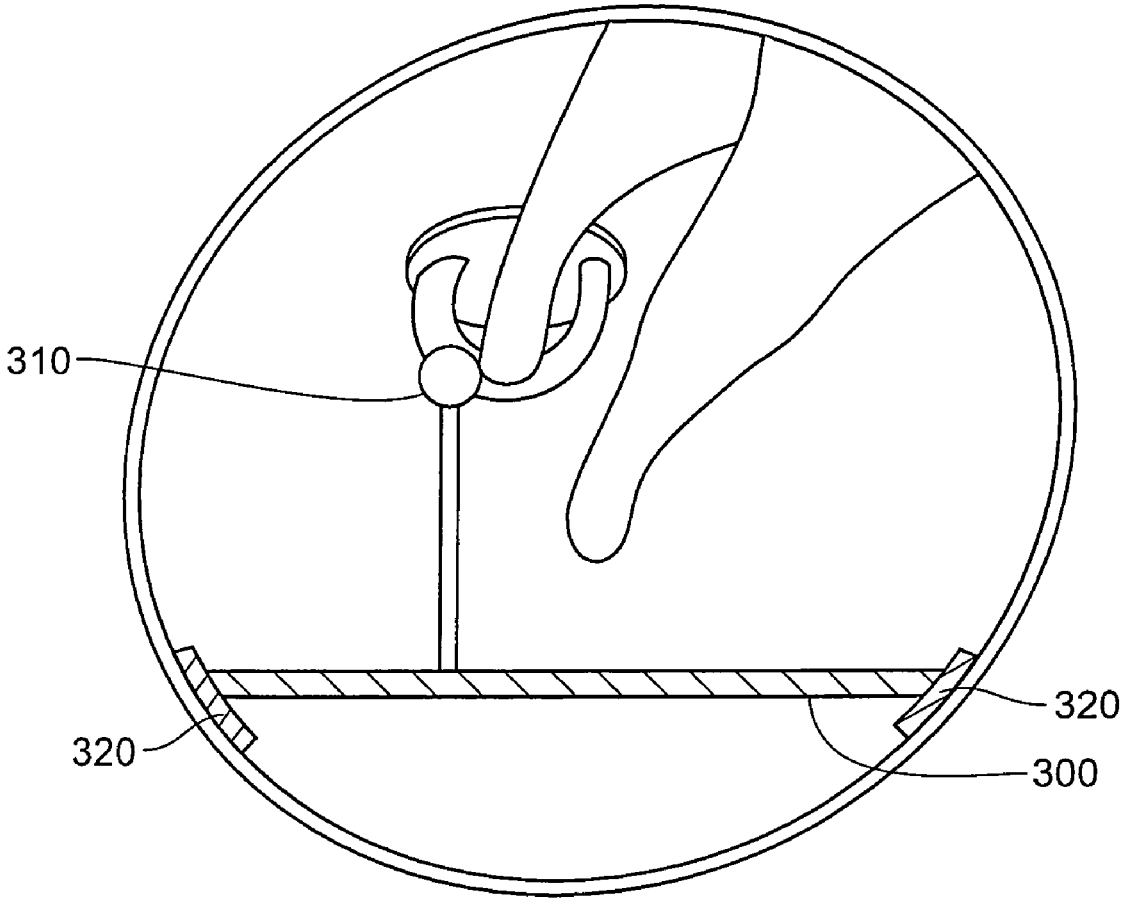

FIG. 6(*a*) is a view into a tympanic cavity after removal of the tympanic membrane. FIG. 6(*a*) shows mounting assemblies 200, 202 for mounting sensing/driver assemblies 210, 212, respectively. As shown, each mounting assembly 200, 202 may include a longitudinal body portion adapted to conform substantially to a surface defining a tympanic cavity (middle ear) 35. The longitudinal body portion of mounting assemblies 200, 202 may be adapted to have a sensing/driver assembly 210, 212 operatively coupled thereto, substantially as shown in FIG. 6(*a*). For example, a housing portion of a sensing assembly 210 may be coupled to the mounting assembly 200 along the longitudinal body portion of mounting assembly 200. Sensing assembly 210 may be coupled to the mounting assembly 200 using a variety of attachment techniques, including adhesives, such as a medical adhesive applied therebetween. In certain preferred embodiments, an adhesive for coupling sensing assembly 210 to mounting assembly 200 may include an aerated medical adhesive, which may also provide some degree of vibration damping or isolation.

A mounting assembly 200, 202 may further include an anchor portion 220, 222 coupled to the longitudinal body portion and adapted to secure the mounting assembly within the tympanic cavity of a patient. An anchor portion 220, 222 may comprise a variety of mechanisms for securing a mounting assembly 200, 202 within a middle ear space according to various embodiments of the invention. For example, anchor portion may comprise bone cement or similar adhesive means for securing mounting assembly 200, 202 to a bony structure within middle ear space (tympanic cavity), or may comprise bone screws or any other comparable attachment mechanisms as are known in the art. In certain embodiments, an anchor portion 220, 222 may be coupled to the longitudinal body portion near a first end of the longitudinal body portion. In some embodiments, more than one anchor portion may be used to secure mounting assembly within tympanic cavity (middle ear) 35.

In certain embodiments of the invention, the longitudinal body portion of the mounting assembly 200, 202 may be adapted to conform to a curved surface of the tympanic cavity. For example, the longitudinal body portion may be formed of a material having a certain degree of malleability such that it may be inserted into tympanic cavity in a relatively straight elongate configuration, and may subsequently be shaped to conform to a substantially vertical surface of the tympanic cavity upon application of pressure or force thereto.

FIG. 6(*b*) shows an alternate embodiment of a mounting assembly 300 for mounting sensing/driver assemblies. The mounting assembly 300 of FIG. 6(*b*) is shown with a driver assembly 310 mounted thereto. Of course, the mounting assembly 300 could be used to support a sensing assembly in an analogous manner. Mounting assembly 300 includes a longitudinal body portion adapted to substantially span a "chord" of a tympanic cavity of a patient, a chord being a segment connecting two points on a curve. The longitudinal body portion of mounting assembly 300 has first and second ends, and may further include fixation means 320 for securing at least one of the first and second ends to a surface (e.g., a bone structure) of the tympanic cavity. The longitudinal body portion may be further adapted to have a sensing/driver assembly operatively coupled thereto, for example, as shown in FIG. 6(*b*).

In certain preferred embodiments of the invention, the longitudinal body portion of mounting assembly 300 may be further adapted to be placed in a substantially horizontal configuration to thereby facilitate supporting a sensing/driver assembly mounted thereon. For example, a longitudinal body portion that is of a length less than the diameter of tympanic cavity may be placed into tympanic cavity using a trans-canal approach, and may be positioned so that the length of the longitudinal body portion is substantially horizontal. Then, placement may be completed by lowering longitudinal body portion until the first and second ends come into contact with the interior surface of tympanic cavity. Fixation means 320 at either or both of the first and second ends may comprise bone cement or similar adhesive means for securing mounting assembly 300 to a bony structure within middle ear space (tympanic cavity), or may comprise one or more bone screws or any other comparable attachment mechanisms as are known in the art.

In some embodiments of the invention, the longitudinal body portion of mounting assembly 300 may be adapted to be passed through the tympanic membrane (e.g., via a slit formed in the tympanic membrane, or via temporary removal of the tympanic membrane) to thereby facilitate a trans-canal placement of the mounting assembly.

Figure 7A:
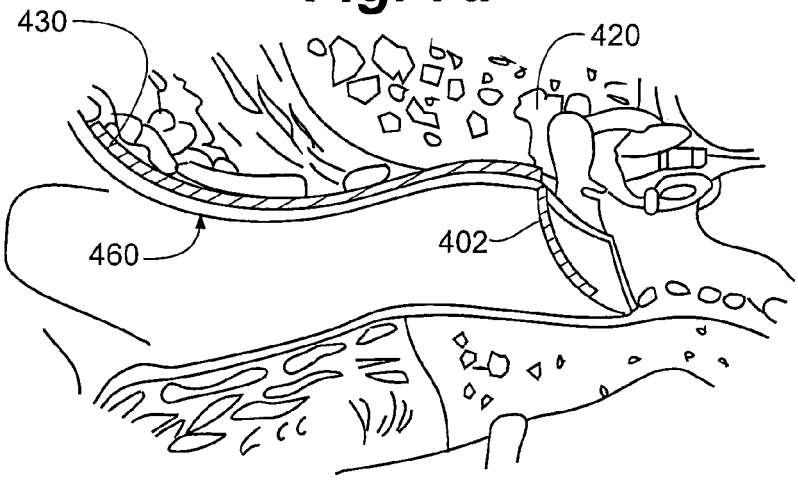
FIGS. 7 (*a*)-(*c*) show several techniques for placement of hearing aid system components in accordance with certain embodiments of the invention.
Figure 7B:
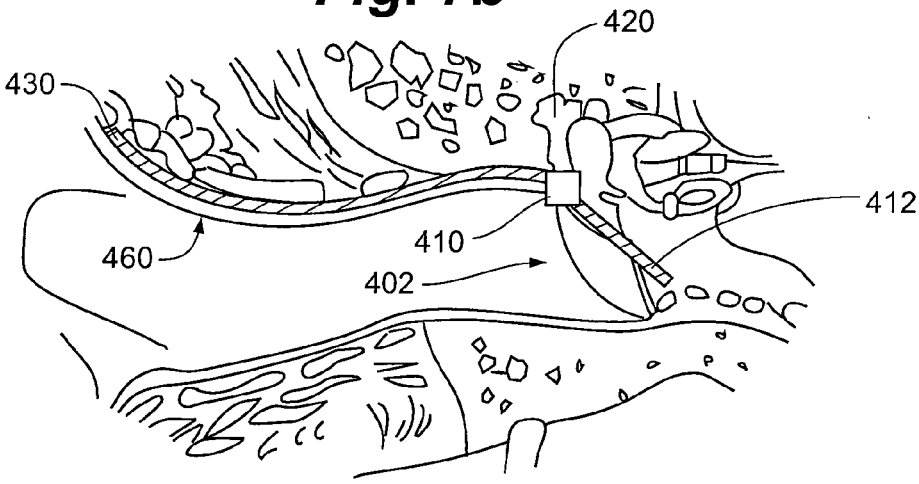
Figure 7C:
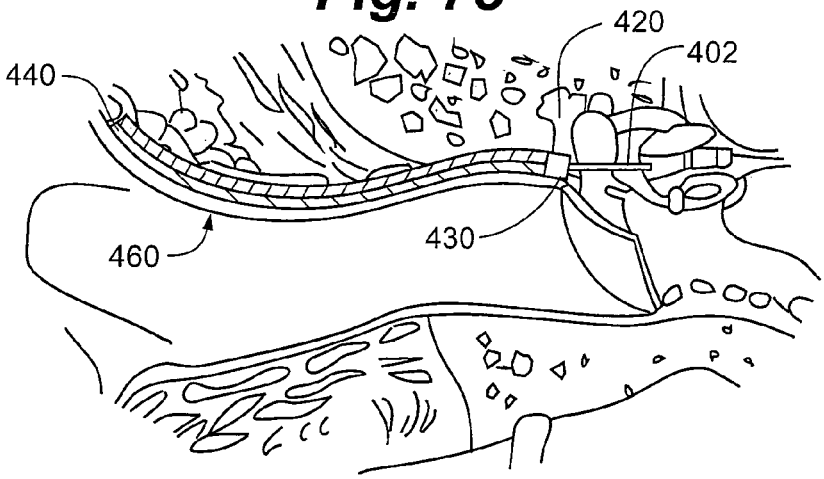

FIG. 7(*c*) shows an additional technique, described below, for installing portions or components of a hearing aid system in accordance with embodiments of the invention, either alone or in conjunction with the methods described above. For example, the installation of a sensing/driver assembly 402 may be facilitated by "tunneling" a lead and/or sensing/driving assembly 402 through the skin of the ear canal. Tunneling may, for example, include placing a "tube" (or sheath) 440 through certain skin areas, or fat tissue, for example. In one possible embodiment, a tube or sheath may be made of titanium and may include an aperture or lumen adapted to pass a lead 430 and/or a sensing/driver assembly 402 therethough, generally as shown at 460 in FIG. 7(*c*). In certain embodiments, this may allow a sensing/driving assembly 402, for example, to be mounted in the epitympanic recess area 420.

As shown in FIG. 7(*c*), the sensing/driver assembly 402 may connect to the upper part of the malleus, or alternatively, to the incus near the fusion of the malleus and incus, for example, to serve as a driver assembly. The sensing/driver assembly 402 may alternatively be placed through the mastoid, as earlier described, to provide an alternate access path to the epitympanic recess and provide an alternate method of mounting the sensing/driver assembly 402, according to certain embodiments. Placement of the sensing/driver assembly in this location, for example, may permit the ossicular chain to be stimulated in a natural way.

To avoid the potential for feedback between the sensing and driver assemblies of the system just described, the ossicular chain may be disarticulated at various locations to minimize or eliminate feedback paths. An example of such a point of disarticulation may be along the malleus neck, for example. Alternate locations for disarticulation of the ossicular chain may include, but are not limited to, between the malleus and the incus, and between the malleus and the tympanic membrane (e.g., at the umbo) as but two examples.

The placement of the sensing/driver assembly 402 may be in the cavity between the tympanic membrane and the malleus, as shown in FIG. 7(*a*), for example. A lead 430 for electrically coupling sensing/driver assembly 402 to an electronics unit (not shown) may be tunneled through (or beneath) the skin surrounding the ear canal, as indicated at reference numeral 460.

Access to the space between the tympanic membrane and the manubrium of the malleus may be obtained through a procedure in which the tympanic membrane is "lifted," or temporarily removed. The sensing/driver assembly 402 may be an accelerometer, a piezoelectric element or piezoelectric film, for example without limitation. Alternatively, the sensing/driver assembly 402 may be attached to the side or back of the manubrium of the malleus in such a way as to minimize interference with the surrounding structures.

As shown in FIG. 7(*b*), a hearing aid system in accordance with certain embodiments of the invention may include the housing portion 410 of a sensing/driver assembly 402 mounted in the epitympanic recess 420, with a length of the transducer portion 412 extending substantially along the axis of the manubrium of the malleus. The sensing/driver assembly 402 may include a piezoelectric transducer element, for example, or other transducer elements as are known in the art. The transducer portion 412 may extend beyond the manubrium, and may further be mass loaded such that the transducer portion 412 of the sensing/driver assembly 402 minimally interferes with the natural motion of the malleus. The mass loading of the transducer portion 412 may also cause greater displacement of the transducer in response to mechanical vibration or motion of the malleus. This may effectively amplify the displacement of the sensing/driver assembly 402, while minimizing the energy absorbed from the malleus.

The leads 430 for electrically coupling the sensing/driver assemblies 402 to an electronics unit (not shown) may be tunneled through the skin surrounding the ear canal, as shown generally at 460 in FIGS. 7(*a*)-(*c*), and as generally known in the art. The tunneling technique may be used in conjunction with the methods, mounting assemblies, and hearing aid systems of the various embodiments of the invention to provide additional flexibility in choosing locations for the placement of hearing aid system components.

Thus, embodiments of a METHOD AND APPARATUS FOR MINIMALLY INVASIVE PLACEMENT OF SENSING AND DRIVER ASSEMBLIES TO IMPROVE HEARING LOSS are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. A method of installing a sensing/driver assembly in a middle ear, the method comprising:

cutting at least a portion of a tympanic membrane comprises removing the tympanic membrane, and wherein the method further comprises reattaching the tympanic membrane after coupling the sensing/driver assembly to the mounting assembly;

placing a mounting assembly through an ear canal into a middle ear space;

affixing the mounting assembly to a bony structure of the middle ear space;

placing a sensing/driver assembly through an ear canal into a middle ear space; and coupling the sensing/driver assembly to the mounting assembly.

2. The method of claim 1 further comprising tunneling leads through an area of skin near the ear canal to provide an electrically coupling to the sensing/driver assembly.

3. The method of claim 2 wherein the sensing/driver assembly is sized to fit within an epitympanic cavity.

4. The method of claim 1 further comprising coupling a sensing/driver assembly to a malleus of a patient to thereby provide sensing of mechanical vibrations.

5. The method of claim 4 wherein the malleus has been disarticulated.

6. The method of claim 4 wherein the sensing/driver assembly is coupled to the malleus at a portion of a manubrium of the malleus to thereby minimize interference with surrounding structures.

7. The method of claim 1 further comprising coupling a sensing/driver assembly to an incus of a patient to thereby provide sensing of mechanical vibrations.

8. The method of claim 1 further comprising:

disarticulating the tympanic membrane of a patient from a malleus; and coupling a sensing/driver assembly to the tympanic membrane of a patient to thereby provide sensing of mechanical vibrations.

* * * * *